United States Patent [19]

Coleman

[11] Patent Number: 4,923,101

[45] **Date of Patent: * May 8, 1990**

[54] BULK MATERIAL CONTAINER WITH A DOOR MOVABLE OVER A RECTILINEAR PATH

[75] Inventor: Clarence B. Coleman, Oakland, Calif.

[73] Assignee: Fabricated Metals, Inc., San Leandro, Calif.

[ * ] Notice: The portion of the term of this patent subsequent to Aug. 22, 2006 has been disclaimed.

[21] Appl. No.: 322,172

[22] Filed: Mar. 13, 1989

Related U.S. Application Data

[62] Division of Ser. No. 594,840, Mar. 29, 1984, Pat. No. 4,858,791.

[51] Int. Cl.[5] ..... B65D 47/00

[52] U.S. Cl. ..... 222/510; 222/552; 251/224; 49/335

[58] Field of Search ..... 222/166, 173, 185, 182, 222/559, 561, 505, 510, 509, 548, 549; 49/373, 326, 333, 354, 362; 220/290, 289, 351, 327, 345

[56] References Cited

U.S. PATENT DOCUMENTS

| | | | |
|---|---|---|---|
| 544,403 | 8/1895 | Decker | 222/166 |
| 953,370 | 3/1910 | Carr et al. | 222/166 |
| 1,125,371 | 1/1915 | Nash | 292/251 |
| 1,278,520 | 9/1918 | Thomason | 251/318 |
| 1,490,417 | 4/1924 | Chesnutt | 137/53.3 |
| 1,693,720 | 12/1928 | Lyons | 222/509 |
| 1,891,032 | 12/1932 | Venable | 222/166 |
| 2,190,723 | 2/1940 | McBride | 137/21 |
| 2,676,610 | 4/1954 | Hare | 137/462 |
| 2,815,237 | 12/1957 | Winterburn et al. | 292/256.71 |
| 2,825,485 | 3/1958 | Van Olst et al. | 292/256.71 |
| 2,877,867 | 3/1959 | Cain et al. | 184/1.5 |
| 3,045,400 | 7/1962 | Grose | 53/37 |
| 3,137,402 | 6/1964 | Gunn, Jr. | 414/314 |
| 3,224,653 | 12/1965 | Cooke | 222/166 |
| 3,280,996 | 10/1966 | McKinney | 222/166 |
| 3,400,860 | 9/1968 | Collins | 222/184 |
| 3,878,600 | 4/1975 | Gilbert | 220/327 |

FOREIGN PATENT DOCUMENTS

| | | |
|---|---|---|
| 1216795 | 5/1966 | Fed. Rep. of Germany . |
| 441093 | 1/1968 | Switzerland . |

OTHER PUBLICATIONS

Advertising Literature–Tote Bin (Four Sheets).

*Primary Examiner*—Michael S. Huppert
*Assistant Examiner*—Kenneth Noland
*Attorney, Agent, or Firm*—Jack M. Wiseman

[57] ABSTRACT

A bulk material container with an opening has a door arranged to move over a rectilinear path for the opening and the closing of the opening. For moving the door over a rectilinear path to either open or close the opening, a threaded shaft is journalled for rotation within the container and is aligned axially with the center of the door. Means on the threaded shaft engage the door so that the door is moved over the rectilinear path by the rotation of the threaded shaft. A gasket surrounds the opening at the time of closure of the door. Continued rotation of the shaft for the closure of the door will cause the gasket to be compressed against the plate surrounding the opening. Rotation of the door is inhibited while the gasket is being compressed.

1 Claim, 3 Drawing Sheets

6
12
13
64
61
24
60
60a
46
42
63
41
26
28
52
53
53a
49
45
40
21
35
25
42a
27
51
40
55
54
13
61
64
12
6

12
24
13
61
63
26
40
41
60

BULK MATERIAL CONTAINER WITH A DOOR MOVABLE OVER A RECTILINEAR PATH

RELATED APPLICATION

This application is a divisional application of my pending application, Ser. No. 06/594,840, filed on Mar. 29, 1984 now U.S. Pat. No. 4,858,791, for Bulk Material Container With A Door Movable Over A Rectilinear Path.

BACKGROUND OF THE INVENTION

The present invention relates in general to bulk material containers, and more particularly to a bulk material container with a door movable over a rectilinear path.

Bulk material containers with side doors or outlets are employed for storing and handling materials containing contaminants or containing food products and chemicals requiring contamination free conditions or for transporting corrosive or dangerous materials. In handling poisons or the like, an operator should not be exposed to the dangerous material. The sealing of the door as well as the activation of the door is of concern in protecting the operator from exposure to or contact with dangerous material and also to prevent the contamination of food products and chemicals.

Side outlet bulk material containers have been manufactured and sold with hinged doors and the seals therefor were inadequate. It is believed that the inadequate seals were present because of the inability to exert sufficient pressure on all edge surfaces of the door to obtain the required seal.

In the patent to McKinney, No. 3,280,996, there is disclosed a bulk material container. The contents of the bin are discharged through a circular opening in the front wall of the bin. A door is moved in the axial direction of the circular opening for the closure and opening of the circular opening. A splined shaft actuates a shaft secured to the door for axial movement to open the access opening against the urgency of a spring. The spring applies a force to a shaft on which the door is secured for the closing of the access opening.

Side outlet bulk material containers have been heretofore manufactured and sold by Hoover Universal. Such side outlet bulk material containers have been manufactured and sold with tiltable unloaders. When the hinged door was opened, the container unloaded under the force of gravity while the container was tilted. In other instances, the container was unloaded by means of a screw conveyor.

SUMMARY OF THE INVENTION

A bulk material container in which a door for an opening in a wall of the container is screw actuated for movement along a rectilinear path for opening and closing the opening.

An arrangement for actuating a door over a rectilinear path for the opening and closing of an opening in a bulk material container employing screw actuating means.

A feature of the present invention is that a gasket surrounds the opening and the door is moved to compress the gasket to form a seal during the closure of the opening. With the door screw actuated along the rectilinear path, the extent of the sealing engagement of the seal between the container and the door is controllable and made more effective. The gasket is compressed by the rectilinear movement of the door and further screw actuation of the door compresses the gasket without rotating the door.

A feature of the present invention is that the door for the opening can be opened and closed from either side of the bulk material container.

A feature of the present invention is that the screw shaft can be rotated from either end to move the door over a rectilinear path for the opening and closing of an opening.

Another feature of the present invention is that the extent or degree of closure or the opening of a door relative to the walls or seal surrounding an opening can be positively controlled.

Another feature of the present invention is that the bulk material stored in the container does not come into contact with the operating parts of the mechanism that imparts a rectilinear movement to the door.

Another feature of the present invention is that the door is opened and closed mechanically with a positive action that does not rely on the force of gravity or the force applied by the weight of the material being discharged from the container through vibrations or oscillations.

DESCRIPTION OF THE PREFERRED EMBODIMENTS

Figure 1:
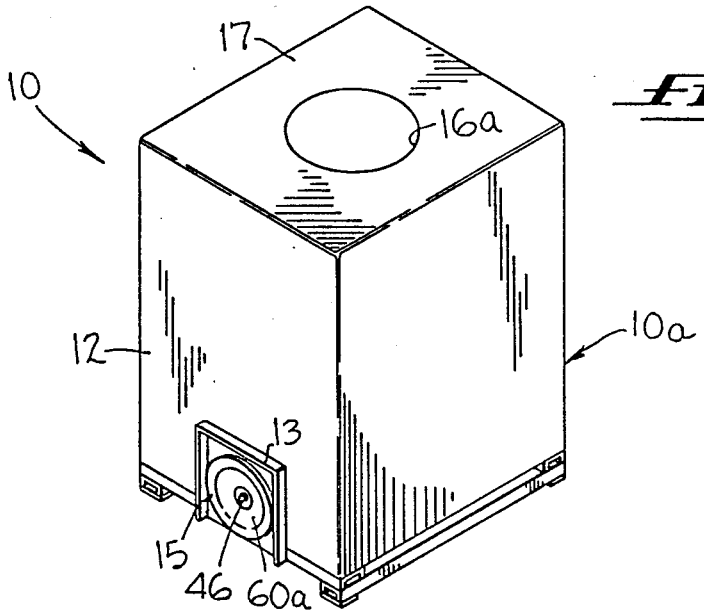
FIG. 1 is a perspective view of a bulk material container embodying the present invention.
Figure 2:
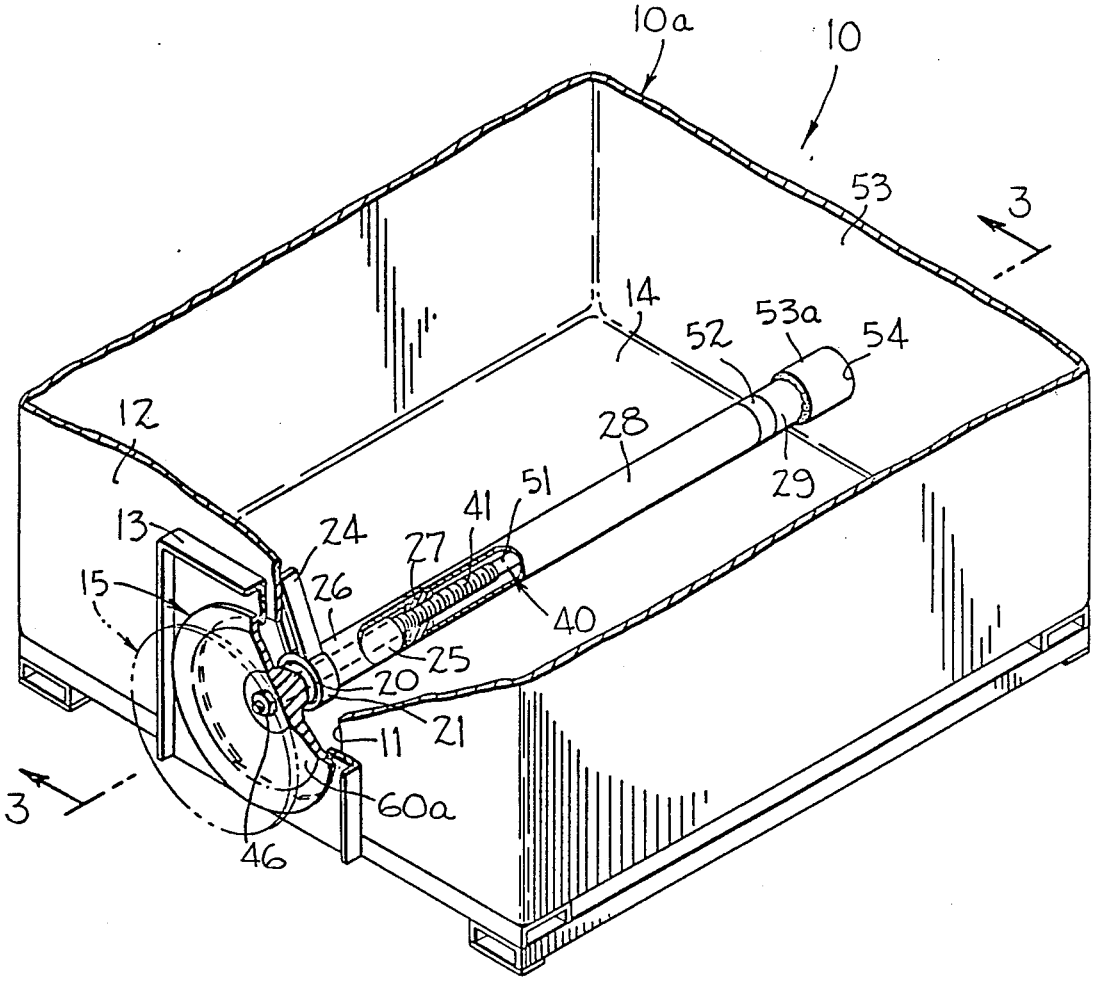
FIG. 2 is a fragmentary perspective of the bulk material container embodying the present invention.

Illustrated in FIG. 1 is a suitable bulk material container 10 having a suitable opening or discharge opening 11 (FIG. 2) formed in a side wall 12 thereof. The walls of the container 10 define a shell 10*a*. Secured to the wall 12 and surrounding the opening 11 is an adapter plate or door frame 13. A door 15 is arranged to open and close the opening 11 through movement along a rectilinear path. While the preferred embodiment employs a round door 15 with a cylindrical wall surrounding the opening 11, it is within the contemplation of the present invention that the door 15 may be configured in different shapes and the opening 11 and the opening formed in the door frame 13 will have a configuration conforming to the contour of the door 15. The discharge opening 11 (FIG. 2) is formed in the wall 12 of the container 10 for gravity unloading. If desired, a screw-type conveyor can be employed for discharging material or any other suitable arrangement can be employed for material discharge, such as tilting, shaking and jolting of the container 10. An opening 16*a* formed in a wall 17 may be employed as a material inlet or service opening for the container 10.

Figure 3:
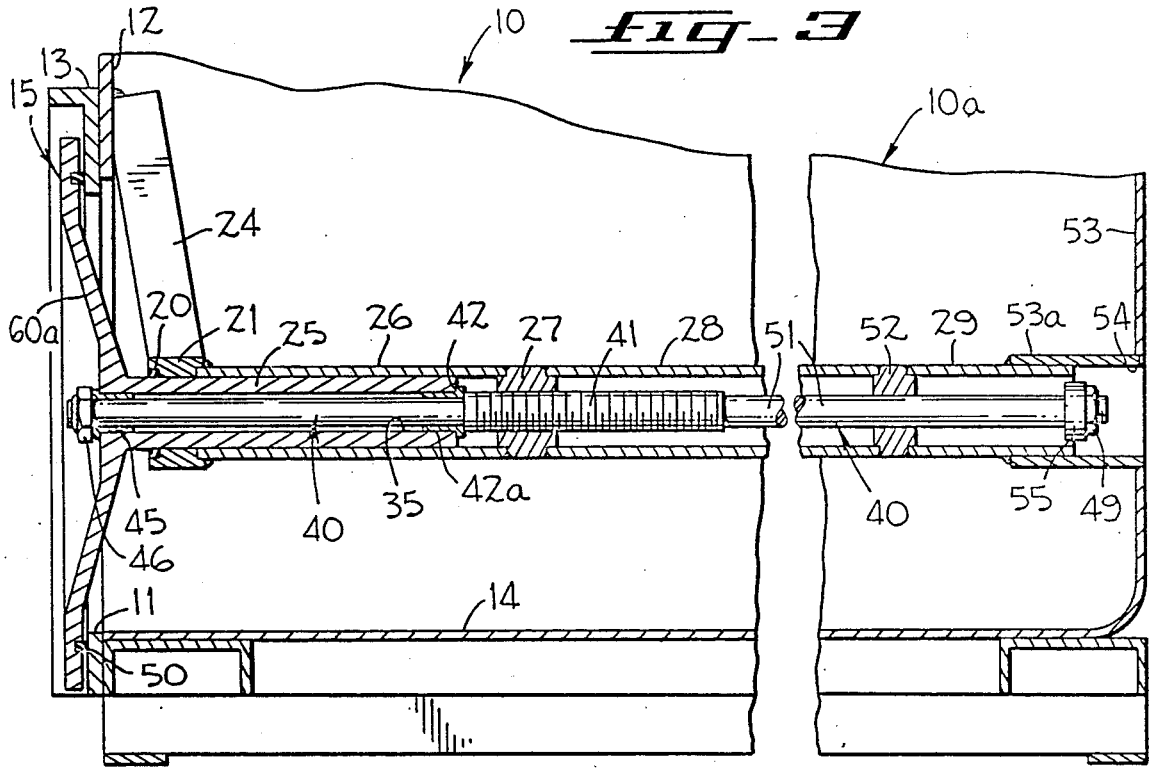
FIG. 3 is a fragmentary axial section view taken along line 3—3 of FIG. 2, to illustrate the screw mechanism for moving a door for an opening formed in the bulk material container along a rectilinear path.

For moving the door 15 over a rectilinear path, the door 15 comprises an integrally formed hub 25 (FIG. 3). In the preferred embodiment, the door 15 is disposed exteriorally of the container 10. Thus, the door 15 is moved outwardly away from the container 10 when the opening 11 is opened and is moved toward the wall 12 of the container 10 when the opening 11 is closed. It is within the contemplation of the present invention that the door 15 can be disposed inwardly of the container 10. Under this circumstance, the door 15 is moved toward the wall 12 to close the opening 11 and is moved away from the wall 12 to open the opening 11.

The hub 25 is telescopically received by a bearing tube 26 made of suitable material, such as aluminum. The bearing tube 26 is of sufficient thickness to prevent distortion in the hub 25 during the actuation of the door 15. Surrounding the hub 25 at the forward end thereof is a seal and shaft wiper 20 and a seal housing 21. Angularly disposed struts or guides 24 are fixedly secured to the seal housing 21 and the wall 12 of the container 10 for supporting the bearing tube 26, the hub 25 and the seal housing 21. It is within the contemplation of the present invention to fixedly secure the struts 24 to the wall 12 of the container 10 and the bearing tube 26. While the exemplary embodiment shows the struts 24 fixed to the wall 12, the struts 24 can be secured to the bottom wall 14 of the shell 10*a*. An internally threaded bushing 27 made of suitable material, such as aluminum, is fixed or welded end-to-end with the tube 26. The threaded bushing 27 is fixedly positioned within the container 10. The threads of the bushing are preferably made of steel.

Fixed to the free end of the threaded bushing 27 by welding or the like is a suitable tube or shaft housing 28. Fixed to the shaft housing 28 by welding or the like is a stop block 52. A tube 29 is fixed to the stop block 52 by weldment or the like. A wall 53 of the container 10 has an adjustment sleeve or tube 53*a* fixed thereto, such as by welding, which, in turn, is welded or secured to the tube 29. An opening 54 is formed in the wall 53 in alignment with a threaded shaft 40. The wall 53 of the container 10 faces the wall 12 of the container 10. The adjustment sleeve 53*a* supports the tubes 26–29 from the wall 53 of the container 10.

A suitable axial opening or bore 35 extends through the hub 25 of the door 15. Disposed within the hub 25 of the door 15 and the tubes 26–29 for rotation is the threaded shaft 40. The shaft 40 is made of suitable material, such as steel. The threaded section 41 of the shaft 40 is disposed in threaded engagement with the internal threads of the fixedly positioned bushing 27. The shaft 40 has a flange type bushing 42*a* fixed thereto to provide an enlarged diameter section that forms a shoulder 42 for engagement with the hub 25 of the door 15. At the end of shaft 40 adjacent the door 15 is a thrust bearing and bushing 45 that engages the end of the hub 25 opposite from the end of the hub 25 that engages the shoulder 42. The bushings 42*a* and 45, in the exemplary embodiment, are bronze bushings. Fixed to the shaft 40 by weldment or the like is a nut 46, which is adjacent to the bearing and bushing 45.

Rotation of the nut 46 by a long handle wrench or other suitable tool imparts rotation to the shaft 40. By rotating the shaft 40, the shaft 40 moves relative to the threaded bushing 27 over a rectilinear path axially of the fixedly positioned tubes 26–29 to impart movement to the door 15 through its hub 25 over a rectilinear path to either open the opening 11 or to close the opening 11. A nut 49, similar to the nut 46, is fixed to the end of the shaft 40 adjacent to the wall 53 by a weldment or the like. A long handle wrench or suitable tool can then impart rotation to the shaft 40 at the opening 54 of the wall 53. The action will then be similar to that described for the rotation of the nut 46. A stop collar 55 is fixed to the shaft 40 and engages the stop block 52 for limiting the movement of the shaft 40.

In the preferred embodiment, a suitable gasket or O-ring 50 is fixed to the round door 15 and is arranged to engage the adapter plate 13 fixed to the wall 12 of the container 10, when the door 15 closes the opening 11. The gasket 50 forms a seal between the door 15 and the adapter plate 13 of the wall 12 of the container 10, when the round door 15 closes the opening 11. Through this arrangement, the sealing compression of the gasket 50 is controlled by the rotation of the shaft 40. Once the gasket 50 engages the plate 13, the door 15 is inhibited from rotating. However, the door 15 will continue to move over a rectilinear path to control the sealing compression of the gasket 50. An effective seal is created between the door 15 of the plate 13 of the wall 12 about the entire edge of the round door 15. While in the preferred embodiment, the seal 50 is fixed to the round door 15, a seal could be attached to the plate 13 surrounding the opening 11 to be engaged by the round door 15.

It is to be observed that the shaft 40 is formed with a reduced diameter section 51 extending from the threaded section 41 to the nut 49. After the door 15 is moved away from the plate 13 to open the opening 11, there is movement of the door 15 to increase the displacement between the door 15 and the opening 11.

Figure 4:
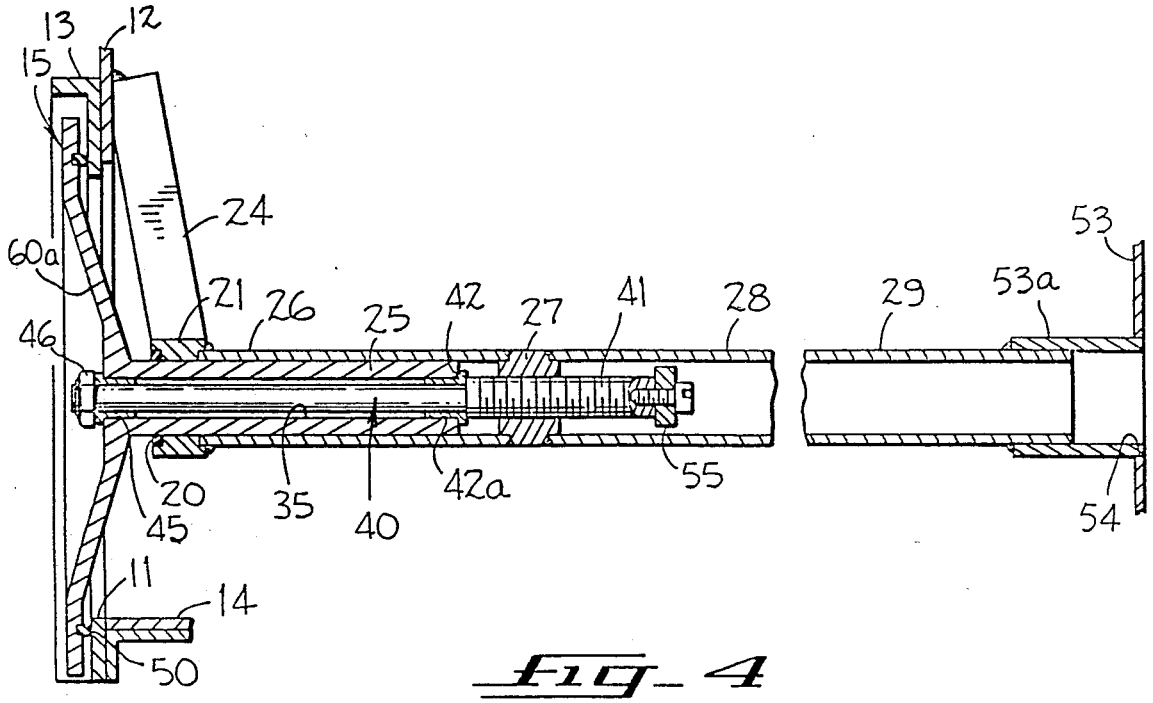
FIG. 4 is a fragmentary axial section view taken along line 3—3 of FIG. 2 to illustrate a modification of the screw mechanism for moving the door from the door side along a rectilinear path.

Illustrated in FIG. 4 is a modification of the shaft 40. The modified shaft 40 (FIG. 4) does not include the reduced diameter section 51 (FIG. 3) but rather has a threaded section 41 to which the stop 55 is affixed. In this manner, the displacement of the door 15 from the plate 13 is controlled entirely by the rotation of the shaft 40 (FIG. 4) from the door end. The block 52, section 51 and nut 49 (FIG. 3) have been omitted. The tubes 28 and 29 constitute a single tube.

Figure 5:
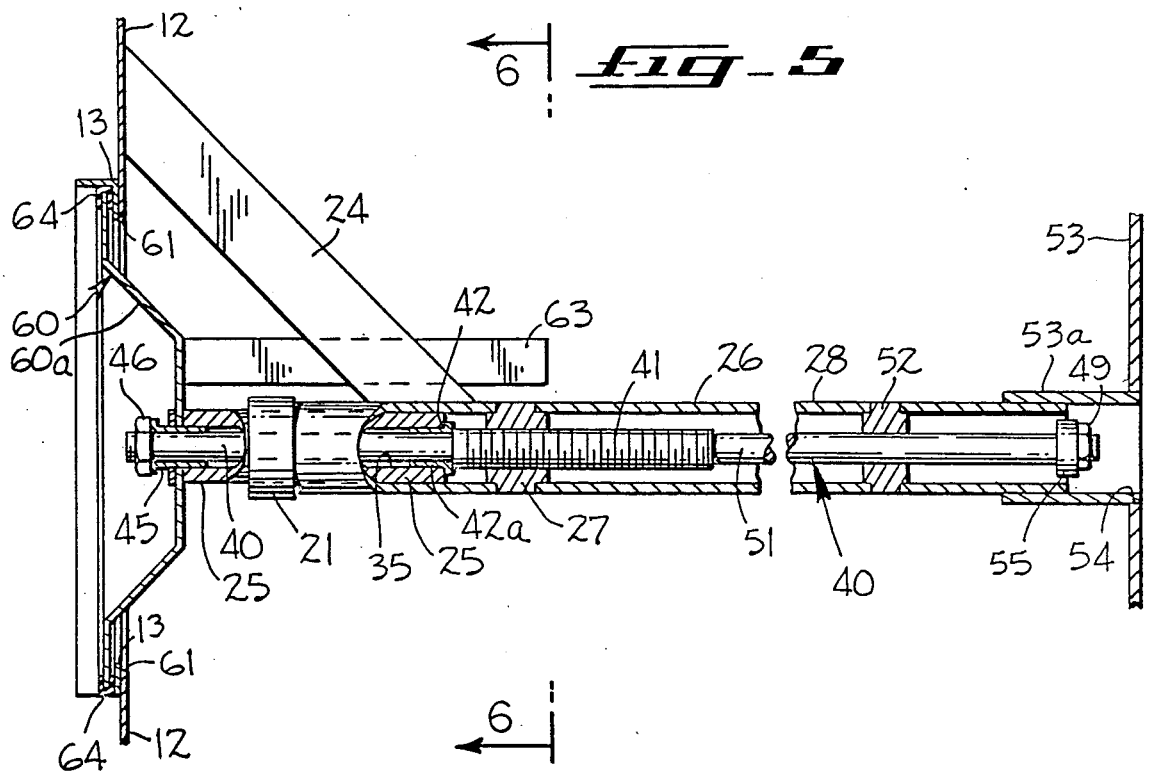
FIG. 5 is a fragmentary axial section taken along line 3—3 of FIG. 2 to illustrate a modification of the configuration of the door for the opening of the bulk material container.
Figure 6:
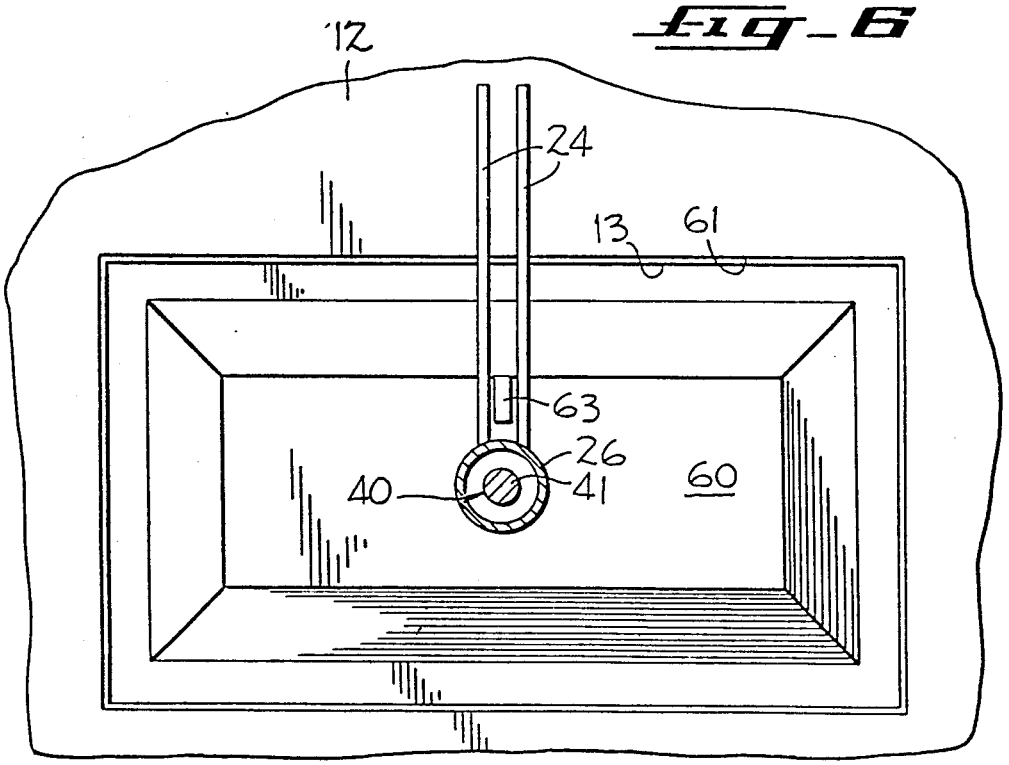
FIG. 6 is a fragmentary elevation view, partially in section, taken along line 6—6 of FIG. 5 to illustrate the door shown in FIG. 5.

Illustrated in FIGS. 5 and 6 is a modification of the door 15 (FIG. 3). In lieu of a round door 15, a rectangular door 60 (FIG. 6) is employed and in lieu of a round opening 11 (FIG. 3) a rectangular opening 61 (FIG. 6) is employed. The door 60 is configured to conform to the shape of the opening 61. The arrangement disclosed in FIGS. 5 and 6 can be employed when a door other than a round door is employed. The struts 24 in FIGS. 5 and 6 are fixed to the wall 12 and the bearing tube 26. Fixed to the door 60 and directed toward the interior of the container 10 for positioning between the spaced struts 24 is a door aligner 63. As the door 60 is actuated for closure with the opening 61, the door aligner 63 moves into the space between the struts or alignment guides 24 to key or orient the door 60 for alignment with the opening 61 so that upon closure the door 60 is precisely located for closing the opening 61. Thus, the tendency for the door 60 to rotate while moving over the rectangular path at closure with the opening 61 is inhibited by the door aligner 63 moving in the space between struts or alignment guides 24.

A gasket 64 embraces the perimetric edges of the door 60 (FIG. 5). A frame 13 surrounds the opening 61 to provide a rigid surface for the seating of the gasket 64 and to assist in the guidance of the door 60 for proper orientation. Once the door 60 is in place, the frame 13 affords protection to the door 60 from external forces applied during the handling of the container.

The door 60 is recessed at 60*a* to protect the operating parts employed in the opening and the closing of the door 60 such as the nut 46 and the shaft 40. Similarly, the recessed area 54 performs a similar function for the nut 49 and the shaft 40. The frame 13, in the preferred embodiment, is fixed to the wall 12 on the exterior side and is flush along the bottom edge so as not to trap material during the unloading of material. Trapped material on the door seat lends itself to causing an inadequate seal for the door.

The gasket 64 is fixed to the door 60 and is arranged to engage the door frame 13 fixed to the wall 12 of the container, when the door 60 closes the opening 61. The gasket 64 forms a seal between the door 60 and the door frame 13, when the door 60 closes the opening 61. Through this arrangement, the sealing compression of the gasket 64 is controlled by the axial movement of the door 60. Once the gasket 64 engages the frame 13, the door aligner 63 and the guides 24 restrict any rotational movement of the door 60 and align the door 60 for accurate seating relative to the opening 61. However, the door 60 will continue to move over a rectilinear path to control the sealing compression of the gasket 64. An effective seal is created between the door 60 and the frame 13 of the wall 12 about all the edges of the door 60 through the gasket 64.

While various components have been described as made of aluminum, it is contemplated that such components will be made of the same material from which the shell 10*a* is made. Generally, dissimilar materials are used on parts that have moving contact with one another, such as threaded rods, nuts, shafts and bearings. However, the parts that merely come into contact with the material in the container generally are made of material compatible with the material in the container.

In the preferred embodiment, the gasket 50 (FIGS. 3 and 4) is a hollow O-ring. When not compressed, the gasket 50 has an annular cross-sectional area. When compressed for forming a seal, the exposed area of the gasket 50 assumes a flat configuration for sealing engagement. While reference is made to the closure and opening of the opening 11 formed in the wall 12, it is apparent that the concept of the present invention is equally applicable to the opening formed in the door frame 13. In the conventional containers 10, well-known internal corner closures and baffles will be employed to direct bulk material toward the discharge opening 11 during the discharge of bulk material from the container 10.

I claim:

1. A bulk material container comprising:

(a) a bulk material container shell having an exterior wall with an opening formed therein;

(b) a door having a plurality of sides and a wall disposed in confronting parallel relation with the wall of said shell, said door being arranged to open and close said opening, said door having fixed thereto a door aligner projecting toward the interior of said container shell;

(c) screw actuating means for imparting movement to said door along a rectilinear path for the opening and closing of said opening and for moving said confronting parallel wall of said door toward and away from said wall of said shell;

(d) a gasket disposed exteriorly of said shell between said confronting parallel walls of said door and said shell, said gasket being arranged to surround said opening exteriorly of said shell and arranged to be compressed between said confronting parallel walls of said door and said shell to form a seal while said door closes said opening; and (e) aligner guide means fixedly disposed within said container shell for guiding said door aligner to select the orientation of said door about its centerline to orient its closure alignment with said opening upon closure with said opening, said aligner guide means comprising spaced members coupled to said container and said screw actuating means, said spaced members being arranged to receive said door aligner therebetween to limit the rotation of said door for selecting the orientation of said door about its centerline to orient its closure alignment with said opening upon closure with said opening.

* * * * *